US007066831B2

(12) United States Patent
Jackson

(10) Patent No.: US 7,066,831 B2
(45) Date of Patent: Jun. 27, 2006

(54) GOLF PUTTER

(76) Inventor: Robert E. Jackson, 20485 Snowmass, Bend, OR (US) 97702

( * ) Notice: Subject to any disclaimer, the term of this patent is extended or adjusted under 35 U.S.C. 154(b) by 89 days.

(21) Appl. No.: 10/835,136

(22) Filed: Apr. 28, 2004

(65) Prior Publication Data

US 2005/0245326 A1 Nov. 3, 2005

(51) Int. Cl.
*A63B 53/04* (2006.01)

(52) U.S. Cl. ..... 473/325; 473/329; 473/330; 473/332; 473/342; 473/340; 473/349

(58) Field of Classification Search ..... 473/324–350
See application file for complete search history.

(56) References Cited

U.S. PATENT DOCUMENTS

| | | | | |
|---|---|---|---|---|
| 1,674,173 | A | 6/1928 | Haupt | |
| 2,472,978 | A * | 6/1949 | Mahon | 473/325 |
| 3,720,410 | A * | 3/1973 | Saytar | 473/562 |
| 3,758,115 | A | 9/1973 | Hoglund | |
| 4,290,606 | A | 9/1981 | Maxwell | |
| 4,871,174 | A | 10/1989 | Kobayashi | |
| 5,078,398 | A | 1/1992 | Reed et al. | |
| 5,344,149 | A | 9/1994 | Miller | |
| 5,890,969 | A | 4/1999 | Bechler | |
| 6,001,030 | A * | 12/1999 | Delaney | 473/329 |
| 6,045,452 | A | 4/2000 | Ahn et al. | |
| 6,402,636 | B1 | 6/2002 | Chang | |
| 6,406,380 | B1 | 6/2002 | Jackson | |
| 6,488,594 | B1 * | 12/2002 | Card et al. | 473/340 |
| 6,638,182 | B1 * | 10/2003 | Kosmatka | 473/331 |
| 6,679,788 | B1 * | 1/2004 | Heinrich et al. | 473/324 |
| 6,860,822 | B1 * | 3/2005 | Vrska, Jr. | 473/324 |

FOREIGN PATENT DOCUMENTS

| | | |
|---|---|---|
| GB | 2338903 | * 12/2000 |
| JP | 59-12916 | 4/1984 |

OTHER PUBLICATIONS

Golfonline, "Odyssey White Hot 2-Ball Putter", magazine article, Dec. 2002.
Edwin Watts Golf, p. 11 from catalog circa 2002, White Hot 2-Ball Putter.
Golfsmith, 2003 Catalog, Jan. 2003, cover page and p. 42.
Master Grip brochure, circa 2002, Master Grip putter.

* cited by examiner

*Primary Examiner*—Sebastiano Passaniti
(74) *Attorney, Agent, or Firm*—ipsolon llp

(57) ABSTRACT

A golf putter has a clubhead that includes a ball striking surface defined by a curved concave surface over which a coating material has been applied. The outer surface of the coating material is substantially flat. The coating material is selected according to desired functional characteristics and hardness.

19 Claims, 2 Drawing Sheets

GOLF PUTTER

FIELD OF THE INVENTION

This invention relates to golf clubs, and more specifically to a putter having an improved club head design for improved putting accuracy.

BACKGROUND OF THE INVENTION

In the game of golf, putting of the ball, either on or off the green, requires a shorter more controlled stroke or swing than other golf shots. A shorter, more controlled swing helps to assure more accuracy and controlled contact with the ball, which in turn increases accuracy of the shot and decreases the likelihood of a mis-hit. It is also often said that putting is one of the single most important aspects of the game. Certainly it is true that missed putts can add significantly to a player's score. Therefore, improvements in a player's putting game can be a significant part of lowering overall scores.

There are numerous putter designs that are intended to improve a player's putting game and to decrease their scores. One such improvement is described in U.S. Pat. No. 6,406,380, in which I am the named inventor, and which is incorporated herein by this reference. One embodiment of the putter described in the '380 patent includes a concave striking face that focuses the golf ball rebound trajectory as the ball travels toward the pin, thereby improving shot accuracy.

Despite the improvements in golf club design generally, and despite the specific improvements described my U.S. Pat. No. 6,406,380 there is an ongoing demand for golf clubs that help improve the quality of the game.

The present invention is directed to an improved golf putter design that incorporates a curved concave ball striking face that is coated with a compound having specified properties. The ball striking face of the putter, defined by the outer surface of the coating material adhered to the curved face, is substantially planar. Nonetheless, the coating material retains some elasticity that imparts a dampening effect so that the desired effects of the underlying curved surface—namely focused ball trajectory—are retained.

BRIEF DESCRIPTION OF THE DRAWINGS

The invention will be better understood, and the numerous objects and advantages of the invention will be apparent by reference to the following detailed description of the invention when taken in conjunction with the following drawings.

DESCRIPTION OF THE PREFERRED EMBODIMENTS

Figure 1:
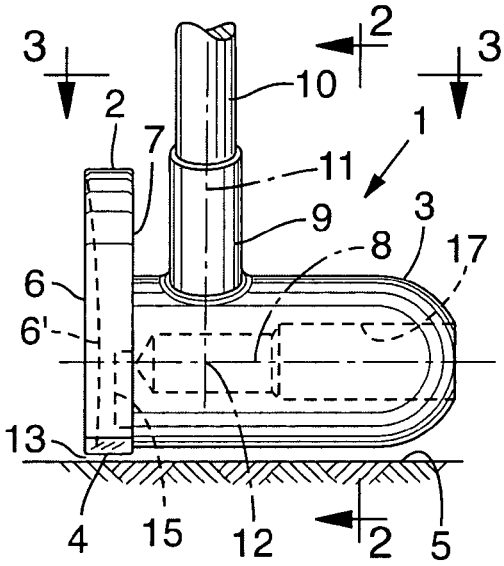
FIG. 1 is a side elevational view of a first illustrated embodiment of a clubhead showing one position of the shaft neck above the center of mass of the clubhead.

A first preferred embodiment of a golf putter clubhead 1 according to the invention illustrated herein is shown in FIG. 1. In the embodiment of FIGS. 1 through 4, two principal body sections define putter clubhead 1, a ball striking plate 2 and a rearward-extending tail portion 3. As may be seen in FIG. 2, the ball striking plate 2 is generally semi-circular and includes a sole 4 formed on the lowermost periphery of the ball striking plate 2 in such a position that the plane of the sole 4 lies parallel to the turf 5 when the putter is in the normal position for striking the ball. That is, sole 4 is a flattened or beveled section formed on the lowermost periphery of the ball striking plate that allows for a smooth putting stroke without effecting the symmetry or concentricity of the clubhead, as described below. As visible in FIG. 2, the outer opposite edges of striking plate 2 along sole 4 may be beveled upwardly relative to the plane of turf 5. Thus, sole 4 includes two beveled sections 20, 22, which preferably are beveled upwardly at an angle of about 10° relative to the plane of turf 5, which is defined herein as the ground plane. The beveled sections 20 and 22 allow for variations in the way that the golfer holds the club so that the ball striking face 6 contacts the ball in the desired position with each stroke.

Figure 2:
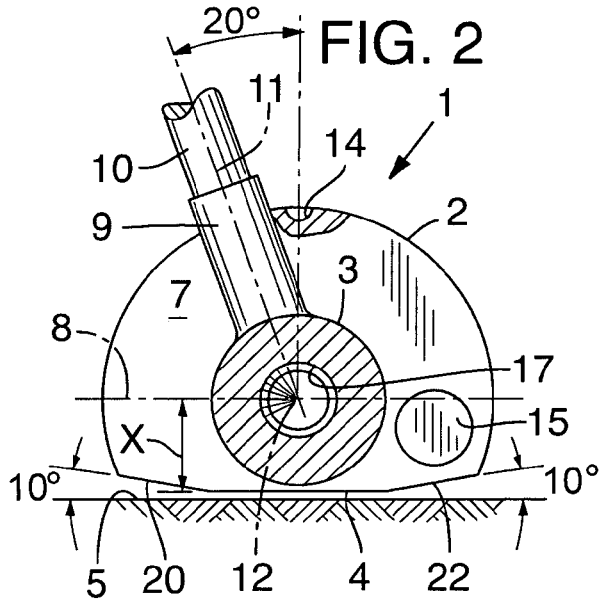
FIG. 2 is a cross sectional rear view of the clubhead of FIG. 1, taken along the line 2—2 of FIG. 1 and illustrating the rearward facing portion of the clubhead with a portion of the ball striking plate removed.
Figure 3:
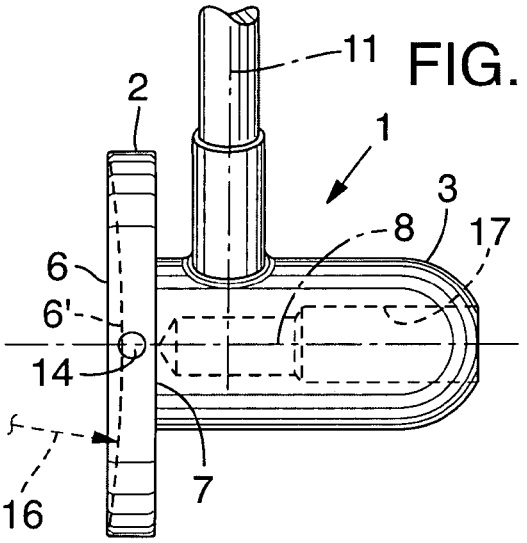
FIG. 3 is a top plan view of a left handed putter identical to the right handed putter shown in FIG. 1, taken along the line 3—3 of FIG. 1 and showing portions of the interior of the clubhead in phantom lines.
Figure 4:
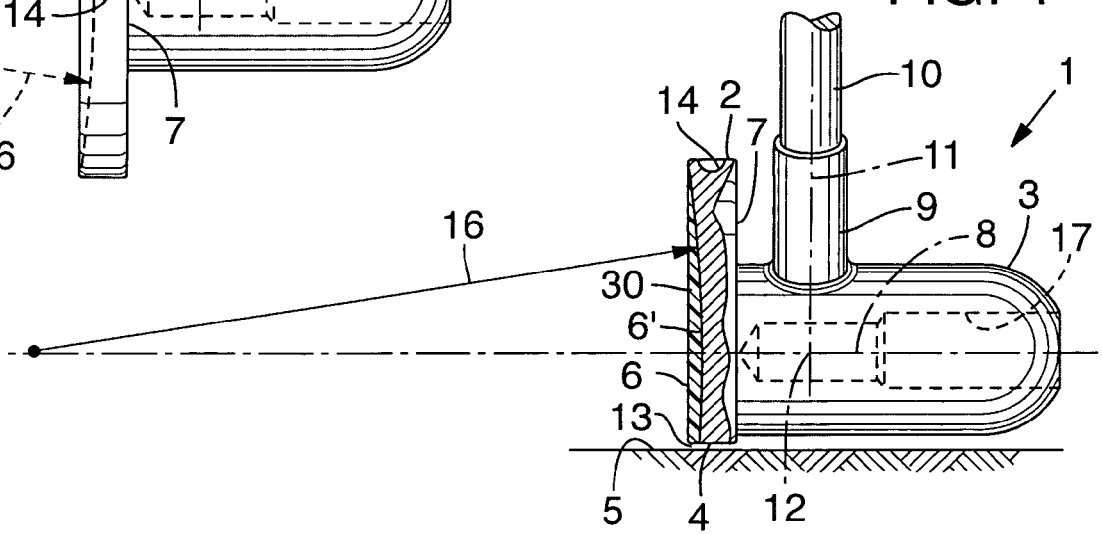
FIG. 4 is a side elevational view of the clubhead shown in FIGS. 1 through 3 with a portion of the ball striking plate cut away to illustrate the forward facing surface of the ball striking plate, and showing a curved concave surface in the ball striking face and a coating material adhered to the curved surface to define an outer, flat ball striking surface.

Clubhead 1 may of course be manufactured as either a right-handed or a left handed club. Thus, a right handed clubhead 1 is shown in FIGS. 1, 2 and 4, and a left handed clubhead 1 is shown in FIG. 3.

Ball striking plate 2 has opposed front and rear surfaces. The forward-facing surface of ball striking plate 2 is defined as that portion of the putter that is presented to the golf ball when the clubhead actually makes contact with the golf ball, and is labeled in the figures with reference number 6. This forward facing surface is sometimes therefore referred to as the ball striking surface of clubhead 1. The rearward-facing surface 7 of the ball striking plate 2 is opposite the forward-facing surface.

As used herein, forward is the direction that a golf ball travels relative to the putter when the ball is stroked, and other directional terms such as rearward, upward, etc. are defined relative thereto. It will be understood that like structures in the drawings are labeled with the same reference numbers.

Tail portion 3 of clubhead 1 extends from the rearward-facing surface 7 of ball striking plate 2. Tail portion 3 is preferentially cylindrical in cross sectional shape and defines a longitudinal axis 8 extending along the length of the tail portion generally transverse to the plane of the ball striking plate when the ball striking plate is vertical relative to the ground plane. The forward facing surface 6 of ball striking plate 2 is substantially flat and defines a plane that is substantially normal to longitudinal axis 8, although as noted below in some instances the plane of the forward facing surface 6 may be angled to provide some measure of loft if desired. This may be done by tilting the ball striking plate 2 relative to the longitudinal axis 8 through tail portion 3, or by machining the forward surface of the striking plate to provide angular loft. A neck 9 for attachment of a club shaft 10 is formed on the tail portion 3 and defines a neck axis 11. Neck axis 11 is normal to and radiates from longitudinal axis 8 through tail portion 3, and as shown in FIG. 2, is angled relative to a vertical axis by about 20°, although the angle of the shaft 10 may be varied according to desire. Clubhead 1 has a center of mass 12 that preferably lies on and is coincident with longitudinal axis 8. Preferably, neck axis 11 intersects longitudinal axis 8 at the center of mass 12 of the clubhead 1.

It should be noted that the length of shaft 10 may be varied to change the style of the club, yet while still incorporating the clubhead 1 described herein. For example, the shaft may be of the type used for standard putters or may be relatively longer for use with so-called belly putters and the like. Additionally, the handle grip applied to the upper end of the shaft may be of any type, such as the relatively long, "dual grip" used in pendulum type putters.

With reference to FIG. 2 it may be seen that the tail portion 3 of the clubhead 1 is concentric with longitudinal axis 8, and that neck axis 11 is coincident with and intersects longitudinal axis 8. The distance from sole 4 to longitudinal axis 8 is labeled with distance line X, which for purposes herein is slightly less than the radius of a golf ball to accommodate some ground clearance between sole 4 and turf 5 during a normal swing. It will be appreciated therefore that when a golf ball is stroked by the clubhead 1 moving through a normal stroke with sole 4 moving closely over turf 5, the ball striking face 6 makes contact with the ball at approximately an equator of the ball. The intersection of longitudinal axis 8 with the forward-facing surface 6 thus defines a ball-contacting area in which the center of mass of the clubhead is effectively concentrated and centered. Assuming that the point of contact between the ball striking face 6 and the ball is approximately at the intersection of the axis 8 and the ball striking face 6, the directional control during putting is improved.

With reference to FIG. 3, it may be seen that a guide indicator or dimple 14 is formed or printed on the upper radial surface of striking plate 2 in a position such that a vertical line transverse to the ground plane bisects the dimple when the clubhead is in a position such as would normally occur when a ball is being stroked. The dimple 14 thus acts as a visual guide for the golfer to align the putter clubface.

In the embodiment of FIGS. 1 through 4, the mass of ball striking plate 2 is relatively less than the mass of tail portion 3. Therefore, it will be appreciated that the size of the semi-circle defined by ball striking plate 2 (FIG. 2) may be increased or decreased without materially altering the concentration of mass of the clubhead. For instance, the size of the ball striking plate may be decreased to approximately the size of a golf ball. As another example, the ball striking plate 2 could be sized such that it is essentially coextensive with the tail portion 3.

Where desired, the total mass of the clubhead, and accordingly the swing weight of the club, could be varied without significantly affecting the clubhead balance and symmetry. This may be done by removing material, core 17, concentric with the longitudinal axis 8 through tail portion 3. Such displaced material could be left as a void or filled with a material dissimilar to the material used to form the clubhead, and of dissimilar density, to attain the desired swing weight. The balance and weight of the clubhead may also be adjusted by removing material from other locations, such as at void 15 formed in rearward facing surface 7.

As noted above, the forward-facing surface 6 of ball striking plate 2 may be tilted slightly relative to longitudinal axis 8 to create loft. The degree of tilt of the forward-facing surface 6 may be varied according to preference, but preferably would not be more than about 5° from vertical. Although forward-facing surface 6 may thus be tilted relative to longitudinal axis 8, the plane of the forward-facing surface of the clubhead remains substantially normal to longitudinal axis 8. As used herein, the words substantially normal contemplate a loft angle of no more than about 5°.

Again, the preferred ball contacting area in the embodiment shown in FIGS. 1 through 4, which may be approximated as the point where longitudinal axis 8 intersects forward-facing surface 6, is where the center of mass of the clubhead is effectively concentrated and centered in a normal golf stroke. Although not shown in the drawings, the forwardmost edge 13 of sole 4, that is, that portion of sole 4 that lies adjacent turf 5 when the club is in use, may be tilted, beveled or radius slightly to facilitate a smooth putting stroke. The contour of forwardmost edge 13 is variable according to preference.

The ball striking surface 6 will now be described in detail. As noted above, and as illustrated in the drawings, the forward facing surface 6 defines a substantially flat or planar surface. However, it may be seen that the forward facing surface is defined by a multi-layered structure having an outermost surface (defined as ball striking surface 6) that is planar, and an underlying or backing surface 6' that, as illustrated in FIGS. 1 through 4, is regularly concavely curved. More particularly, in the embodiments illustrated in FIGS. 1 through 4 the forward-facing portion of backing surface 6' is formed as an arc section of a sphere having a spherical radius 16 having its center on the longitudinal axis 8 of the tail portion 3. During manufacture of clubhead 1, backing surface 6' is formed with the desired spherical radius, for example by milling the ball striking plate 2 or, if the clubhead 1 is cast, by forming an appropriate mold. The length of radius 16 determines the radial curvature of backing surface 6', and may be varied but ideally would correct for mis-hits, off the longitudinal axis 8 on longer putts. The radial surface thus focuses the ball rebound trajectory back to the longitudinal axis 8 at the center point of the radius. The length of such radius 16, and thus the curvature of backing surface 6' may be varied widely according to desire. One preferred length of radius 16 is between about 5 to 10 feet. It will be appreciated that where radius 16 is in the preferred range of between about 5 to 10 feet, the radius shown in drawing FIG. 4 is exaggerated for the purposes of illustration. Moreover, the radius 16 may be different from the preferred ranges just noted so long as the beneficial effects of the curved backing surface 6' is maintained.

After the backing surface 6' has been formed in the forward facing surface of striking plate 2, a surface coating 30 is then applied over the curved backing surface 6'. Surface coating 30 is preferably a polymer material such as polyurethane that may be applied over backing surface 6' as a liquid, and which bonds permanently to the backing surface. After the liquid coating 30 has dried and/or cured, the hardened coating 30 is ground, milled or otherwise flattened so that the forward facing portion of the surface is flat, as illustrated, to thereby define an outer, flat ball striking surface 6. Stated another way, the coating material is ground until forward facing surface 6 is planar. Although in the drawings the coating 30 is shown extending to the periphery of backing surface 6', the coating need not be applied over the entire surface of backing surface 6'. Stated another way, the ball striking surface 6 may be defined by a flattened portion of coating 30 that is applied to only a portion of the surface of backing surface 6'. The ball striking surface 6 may optionally include face markings if desired.

It will be appreciated that the coating material 30 described above when coated onto the curved backing surface 6' defines a plano-convex lens, which, owing to the elasticity of the coating material 30, focuses the ball trajectory as the ball rebounds off the flat portion of the lens, the planar ball striking surface 6. A plano-convex lens has a planar interface on one side and a convex interface on the opposite side. In optical applications, such lenses may be used to focus, collect and collimate light along a principal axis through the lens. With respect to the present clubhead 1, the rearward facing surface of the coating material 30, that is, the surface that is adhered to curved backing surface 6' defines the convex portion of the plano-convex lens, and the forward facing surface of the coating material, that it, ball striking surface 6, defines the planar portion of the plano-convex lens. The longitudinal axis 8 is analogous to the principal axis through a plano-convex lens.

The functional effect of the coating material 30 that defines a plano-convex lens having specified hardness is that the trajectory of a golf ball rebounding off the ball striking surface 6 is focused onto a point on the longitudinal axis 8. The distance that the point lies from the ball position when it is struck is defined by the length of radius 16.

The material used for coating 30 is selected for its ability to provide some elasticity, yet retain a durable, hard surface. Numerous coating products are commercially available that are suitable for use herein. Coating 30 is preferably a polymer such as a polyurethane, although numerous polymers having the characteristics noted herein are commercially available from a variety of suppliers. As noted, coating 30 must have some elasticity yet must have desired hardness and durability. One measure of these characteristics is the durometer hardness of the coating material, which often is expressed in terms of durometer A and durometer D scales. The durometer hardness of the material selected for coating 30 is important because the relative hardness of the coating 30 directly effects the manner in which a golf ball rebounds off of ball striking surface 6. Preferably, the durometer hardness of the material selected for use in coating 30 is in the range of between about 80 durometer A to about 75 durometer D, and more preferably about 90 durometer A.

Various materials may be used to form clubhead 1, including for example various grades of stainless steel, aluminum, bronze, brass or ceramics, or combinations of these materials. The clubhead may be manufactured by conventional means, including milling, casting and molding. Regardless of the material used or the manner in which the clubhead is formed, the material used for coating 30 must be selected so that a permanent bond is formed between the material used in ball striking plate 2, and coating 30.

As noted, forward facing surface 6 is flat and backing surface 6' is curved. When the material used for coating 30 has durometer hardness in the range noted above, the ball striking face define by surface 6 has some elasticity so that when a golf ball is stroked with clubhead 1, the trajectory of the ball is influenced by the curvature of backing surface 6', even though the forward facing surface 6 that makes contact with the ball is flat. Stated another way, although the ball striking surface 6 is flat, the relative elasticity of coating 30 allows the beneficial ball trajectory focusing effect attributable to the curved backing surface 6', as described above, to be retained.

Although not shown in the Figures, the backing surface 6' of ball striking plate 2 may alternately be formed as an arc section of a cylinder prior to coating with coating 30. The longitudinal axis through such cylindrical arc section would be preferably oriented normal to the plane defined by the sole 4, and would be positioned such that it intersects with the longitudinal axis 8 through the tail portion 3. The radius could be variable but again ideally would correct for mishits, off the longitudinal axis 8 on longer putts, and would focus the ball rebound trajectory back to the clubhead axis at the center point of the radius. Such radius 16 for a radially formed backing surface 6' that defines a cylindrical arc section might ideally be about 5 to 10 feet.

Thus, the backing surface 6' may be defined by an arc section of a sphere or an arc section of a cylinder, and in either case the backing surface 6' is defined by a regularly curved concave surface.

Certain alternative configurations and structures may be made to the foregoing embodiments without effecting the invention. For example, while the preferred cross sectional shape of tail portion 3 is circular, the tail portion 3 could be formed in other cross sectional configurations, such as triangular or square, while maintaining the center of mass of the clubhead along a longitudinal axis through the tail portion.

Figure 5:
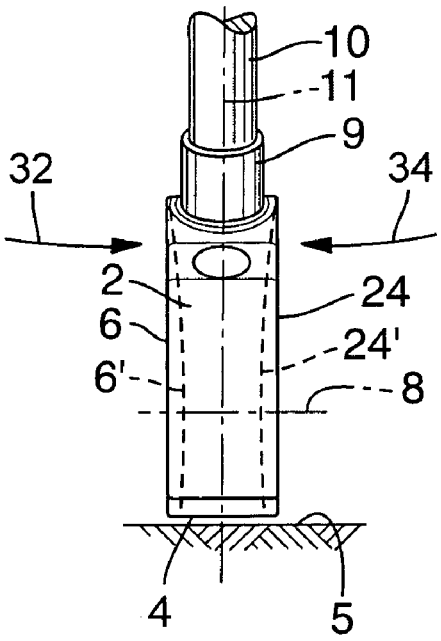
FIG. 5 is a side elevational view of a first alternative embodiment of a clubhead formed according to the present invention.
Figure 6:
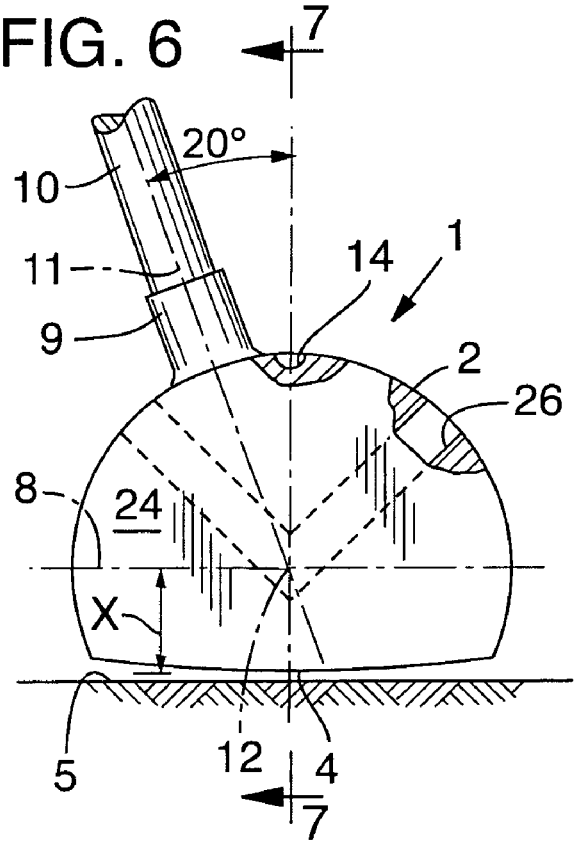
FIG. 6 is a rear view of the clubhead shown in FIG. 5 with a portion of the ball striking face removed.
Figure 7:
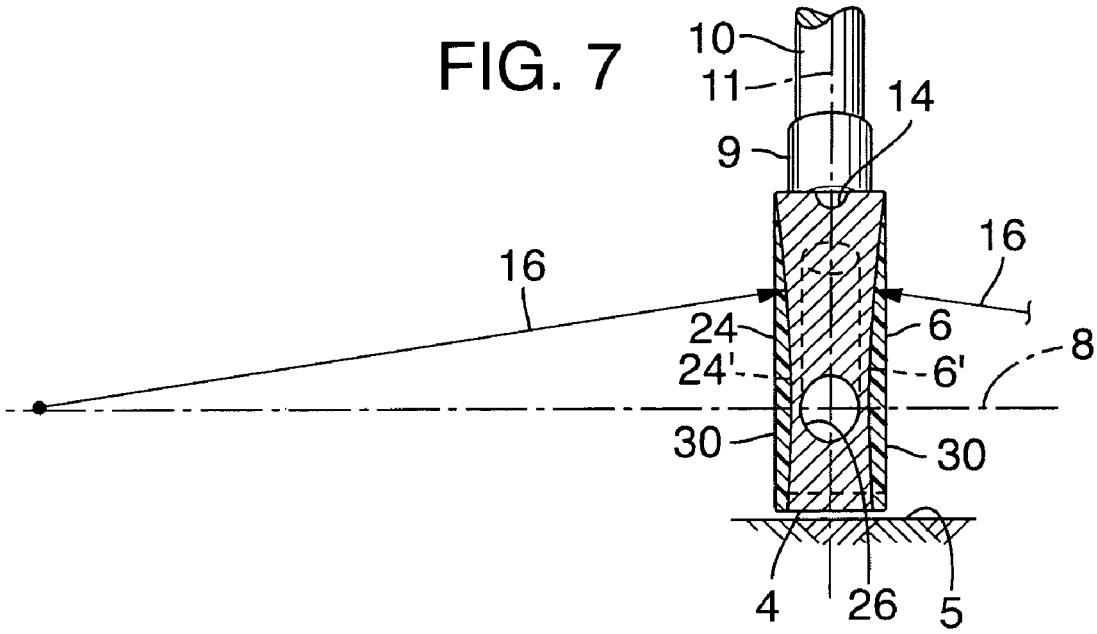
FIG. 7 is a cross sectional view of the clubhead shown in FIG. 6, taken along the line 7—7 of FIG. 6 to illustrate the opposed surfaces of the ball striking plate, and showing each with a curved concave surface onto which a coating material has been adhered to define opposed outer, flat ball striking surfaces.

Turning now to the embodiment illustrated in FIGS. 5 through 7, it may be seen that a putter according to the present invention may be formed without the tail section 3. With reference to those figures, the clubhead 1 may be formed with opposed ball striking surfaces 6 and 24, on both sides of the shaft 10. The first ball striking surface 6 is defined by a backing surface 6' that is formed as described above with reference to FIGS. 1 through 4 so that it is a curved concave surface, for example, either a spherically radially formed surface or a cylindrical section having radius 16. A coating 30 as detailed above is applied to backing surface 6' and after the coating has cured, the coating is ground so that forward facing surface 6 is flat. The opposite side of ball striking plate 2 is likewise defined by a curved concave backing surface 24' that is coated with a coating 30 that is ground to define a flat surface. The result is a clubhead 1 that has opposed ball striking faces 6 and 24, each of which is flat but coated with a polymer that provides the benefits of the curved surface underlying the flat ball striking face. An ambidextrous player may use this type of a putter, as illustrated with arrow 32 depicting the direction of putter movement for a left handed putt, and arrow 34 depicting the direction of movement for a right handed putt. The swing weight of the clubhead 1 shown in FIGS. 5 through 7 may be varied by removal of material from ball striking plate 2, as illustrated with core sections 26, which may be left as voids or filled with materials having a mass dissimilar from the other materials used in the clubhead.

It is understood that the above discussion and details of the preferred embodiments and drawings are exemplary of the present invention and that changes in structure and configuration of golf putters may be effected without departing from the scope of the present invention and equivalents as defined in the following claims.

The invention claimed is:

1. A golf putter head comprising, a ball striking plate having a forward-facing surface, said forward-facing surface having a first continuously concave surface therein with a coating over the entire surface thereof, wherein the coating defines a forward-facing golf ball striking surface that is flat over the entire surface of said coating.

2. The golf putter head according to claim 1 wherein the coating has a durometer hardness of between about 80 durometer A to about 75 durometer D.

3. The golf putter head according to claim 2 wherein the coating has a durometer hardness of about 90 durometer A.

4. The golf putter head according to claim 1 wherein the coating comprises polyurethane.

5. The golf putter head according to claim 1 wherein the first concave surface is further defined by a spherically curved surface.

6. The golf putter head according to claim 5 including an elongate tail portion extending from a rearward side of said ball striking plate and defining a longitudinal axis, and wherein the center of a sphere defined by said spherically curved surface lies substantially on the longitudinal axis through the elongate tail portion.

7. The golf putter head according to claim 6 including a shaft neck connected to the tail portion and defining a neck axis that is normal to and radiating from the longitudinal axis of the tail portion, and wherein said neck axis intersects said longitudinal axis.

8. The golf putter head according to claim 7 in which the golf putter head has a center of mass on the longitudinal axis and in which the neck axis intersects the center of mass.

9. The golf putter head according to claim 1 wherein the first concave surface is further defined by a cylindrically curved surface.

10. The golf putter head according to claim 1 wherein said ball striking plate further defines a second concave surface oriented opposite said first concave surface, and wherein said second concave surface includes a coating applied thereto, wherein the coating defines a second flat golf bail striking surface.

11. A golf putter clubhead, comprising:

a clubhead including a forward-facing ball striking face that is defined by a plano-convex lens, said plano-convex lens defined by a continuously concave surface formed in a forward-facing surface of the clubhead, said concave surface having a coating applied over the entire surface thereof, said coating having a forward-facing surface that defines the ball striking face and which is a planar over the entire surface thereof, and wherein said coating has a variable thickness.

12. The golf putter clubhead according to claim 11 wherein the plano-convex lens is defined by a concave surface having a radius of between about 5 to 10 feet, and wherein the forward facing surface of the coating is flat.

13. The golf putter according to claim 12 wherein the coating is an elastic material.

14. The golf putter according to claim 13 wherein the coating has a durometer hardness of between about 80 durometer A to about 75 durometer D.

15. A golf putter head comprising, a ball striking plate having a forward-facing surface with a first concave surface formed therein, with a first coating over at least a portion thereof, wherein said first coating has an outer face that defines a first ball striking face, and said ball striking plate having a rearward-facing second concave surface formed therein opposite said first concave surface, said second concave surface with a second coating over at least a portion thereof, wherein said second coating has an outer face that defines a second ball striking face, and wherein the entire first and second ball striking faces are flat over the entire surfaces thereof.

16. The golf putter head according to claim 15 wherein the first and second golf ball striking surfaces define plano-convex lenses.

17. The golf putter according to claim 15 wherein the trajectory of a golf ball impacted by the first golf ball striking surface is focused at a point between about 5 and 10 feet from the point of impact.

18. The golf putter head according to claim 17 wherein the first concave surface is defined by a spherically curved surface.

19. The golf putter head according to claim 17 wherein the first concave surface is defined by a cylindrically curved surface.

* * * * *